United States Patent [19]

Stone

[11] 4,132,143

[45] Jan. 2, 1979

[54] FRETTED MUSICAL INSTRUMENT WITH DETACHABLE FINGERBOARD FOR PROVIDING MULTIPLE TONAL SCALES

[75] Inventor: Thomas D. Stone, Novato, Calif.

[73] Assignee: Intonation Systems, Fairfield, Iowa

[21] Appl. No.: 757,427

[22] Filed: Jan. 6, 1977

[51] Int. Cl.[2] ..... G10D 3/06

[52] U.S. Cl. ..... 84/314; 84/293

[58] Field of Search ..... 84/314, 293

[56] References Cited

U.S. PATENT DOCUMENTS

| | | | |
|---|---|---|---|
| 651,304 | 6/1900 | Eriksen | 84/314 |
| 4,023,460 | 5/1977 | Kuhnke | 84/314 |

FOREIGN PATENT DOCUMENTS

| | | | |
|---|---|---|---|
| 446300 | 6/1927 | Fed. Rep. of Germany | 84/314 |
| 440661 | 7/1912 | France | 84/314 |
| 285950 | 2/1928 | United Kingdom | 84/314 |

*Primary Examiner*—Lawrence R. Franklin

*Attorney, Agent, or Firm*—Townsend and Townsend

[57] ABSTRACT

A fretted stringed musical instrument with a readily removable fingerboard to enable performance of musical compositions written in different tonal scales by removing a fingerboard having fret placement in accordance with one tonal scale, e.g. equal tempered scale, and installing another fingerboard having fret placement in accordance with a different tonal scale, e.g. just intonation scale.

Several alternate arrangements permit a given fingerboard to be quickly installed or removed without removing or slackening the strings so that fingerboards may be exchanged in the course of a concert to permit performance of musical pieces from several tonal systems on a single basic instrument.

13 Claims, 10 Drawing Figures

FRETTED MUSICAL INSTRUMENT WITH DETACHABLE FINGERBOARD FOR PROVIDING MULTIPLE TONAL SCALES

BACKGROUND OF THE INVENTION

This invention relates to fretted stringed musical instruments.

Fretted stringed musical instruments have been known for centuries and are popular musical instruments which have been used by musicians of various cultures to express their music. A fretted musical instrument employs one or more elements termed frets which function to shorten the length of a vibrating string by stopping the string at a precise point to thereby alter the pitch or frequency of the sound produced by the vibrating string. Fretted musical instruments may be generally divided into two catagories: those having fixed frets and those having moveable frets. Examples of musical instruments with fixed frets are guitars, banjos, ukeleles, dulcimers, and the like, each of which is provided with relatively narrow ridged fret members of a hard surface finish extending transversely of the fingerboard at precisely spaced locations along the length of the overlying strings. The frets are typically embedded in transverse mating slots in the fingerboard in such a fashion as to be difficult to remove, and the fingerboard adhered to the facing surface of the neck by glue and/or wood screws so that a permanent bond is created between the fingerboard and the neck. Thus, while individual worn frets can be replaced by new frets, the fingerboard cannot. Examples of stringed musical instruments employing moveable frets are the lute and other instruments popular during the Renaissance and Baroque periods in Western Europe, the sitar of India and other instruments which employ mechanisms for enabling the location of a fret relative to the length of the overlying strings to be changed.

In a fixed fretted stringed musical instrument, the available tones are fixed and finite and are predetermined by the distance between the individual frets and the remaining vibration stopping point for the strings, such as the bridge of a monochord or koto, or the saddle of a modern guitar. The number of available tones on stringed musical instruments provided with moveable frets is theoretically infinite. However, in practice the number of tones actually employed is limited by the subjective aesthetic judgment of the musician.

The set of available tones provided by a fretted stringed musical instrument may be referred to as a tonal scale. In fixed fretted stringed musical instruments, the tonal scale is invariant and determined in advance by the manufacturer of the musical instrument. For example, in modern guitars, banjos, ukeleles and the like, the commonly available scale is the equal tempered scale. This tonal scale was invented and introduced into Europe in about the year 1700 A.D. and has been widely implemented in musical instruments in Western civilization primarily since this arrangement permits modulation between any of the 12 major and 12 minor keys comprising the tonal scale. In movable fretted stringed musical instruments, various tonal scales can be provided by adjusting the individual placement of each of the frets in accordance with the musician's subjective desires. However, readjustment of known movable fretted stringed instruments is time consuming and subject to the vagaries of the subjective asthetic capabilities of the person adjusting the device.

Both professional and amateur musicians using fixed fretted stringed musical instruments suffer from what may be termed "scale limitation", viz. the fact that the only fixed fretted stringed instruments commonly available on the market employ the equal tempered scale alone. Because of this "scale limitation", countless melodies from other cultures and other eras cannot be performed on commonly available fixed fretted stringed musical instruments. Thus, in order to perform musical compositions written for other tonal scales than the equal tempered scale, the musician must either purchase an extremely costly, custom made fretted stringed instrument, or attempt to employ one of the known types of moveable fretted stringed instruments. The former alternative is also inconvenient since the number of different instruments required is equal to the number of different tonal scales. While some known movable fretted stringed instruments can be adjusted to provide a different tonal scale in which the music of a past or present culture has been written, the adjustment process is long, difficult, imprecise and impossible to perform unless the musician is already familiar with the desired scale and is possessed of perfect pitch or is extremely well trained in tuning. Even under these optimum circumstances, however, a performer desiring to adjust a movable fretted stringed instrument of known type to a different tonal scale must stop his performance for the length of time required for the adjustment, which is at best inconvenient to both performer and audience and at worst physically impossible given the time limitation on a conventional concert performance. As a result, most performers are discouraged from exploring the numerous musical possibilities available with different tonal scales.

SUMMARY OF THE INVENTION

The invention comprises method and apparatus for rendering available on a single fretted musical instrument a wide variety of different tonal scales, which invention is relatively inexpensive to implement and which enables different tonal scales to be provided on a given instrument in an extremely short period of time on the order of a minute or so.

In the preferred embodiment, a guitar or similar fretted stringed instrument is provided with a removable fingerboard having fret placement in accordance with a given tonal scale. A plurality of such fingerboards are provided for a single musical instrument, with each fingerboard having fret placement in accordance with a different tonal scale. Each fingerboard is adapted to be detachably mounted in rapid and convenient fashion from the fingerboard mounting member of the instrument, e.g. the neck of a guitar, without necessitating the removal or even slackening of the strings.

Several alternate fastening means are provided for securing the fingerboard to the fingerboard mounting member of the instrument with the frets in proper alignment along the length of the strings. In a first embodiment, the upper surface of the fingerboard mounting member is provided with a plurality of longitudinally spaced pin-like projections and longitudinally spaced magnetic or magnetizable elements permanently secured therein, with the latter elements flush with the surface of the fingerboard mounting member in the direction of the strings. Each removable fingerboard is provided with a corresponding plurality of spaced channels extending partially across the width of the fingerboard mounting member and terminating in a closed end, and a corresponding plurality of magnetic or magnetizable elements mounted flush with the underlying surface of the fingerboard facing the upper surface of the fingerboard mounting member. When installed, the pin-like projections extend into the corresponding channel in engagement with the closed end of the channel thereby providing a reference stop for aligning the fingerboard on the fingerboard mounting member, and the magnetic and magnetizable members located in the fingerboard mounting member and the fingerboard are positioned in registry to provide a holding force for maintaining the fingerboard substantially stationary with respect to the fingerboard mounting member of the instrument. In an alternate embodiment, the fingerboard and the fingerboard mounting member are provided with complementary dove-tailed members which permit the fingerboard to be slidably attached to the fingerboard mounting member, one of the two sets of complementary dove-tail members being provided with a limit stop means for accurately positioning the fingerboard on the fingerboard mounting member. In another alternate embodiment of the invention, the fingerboard is provided with a plurality of internally threaded members permanently secured therein at accurate locations and accessible from the lower surface thereof, and the fingerboard mounting member is provided with a plurality of through bores for receiving externally threaded bolt members adapted to be inserted from below the fingerboard mounting member into the internally threaded members in order to secure the fingerboard and fingerboard mounting member together.

Each fingerboard is provided with a plurality of frets at predetermined locations therealong. For some musical scales, each fret may extend completely across the width of the fingerboard as is common with fretted stringed instruments employing the equal tempered scale. In order to construct other musical scales, however, at least some of the frets are of limited length, extending only partially across the fingerboard, and longitudinally spaced from the adjacent fret corresponding to the same step on the tonal scale.

For a fuller understanding of the nature and advantages of the invention, reference should be had to the ensuing detailed description taken in conjunction with the accompanying drawings.

DESCRIPTION OF THE PREFERRED EMBODIMENTS

Figure 1:
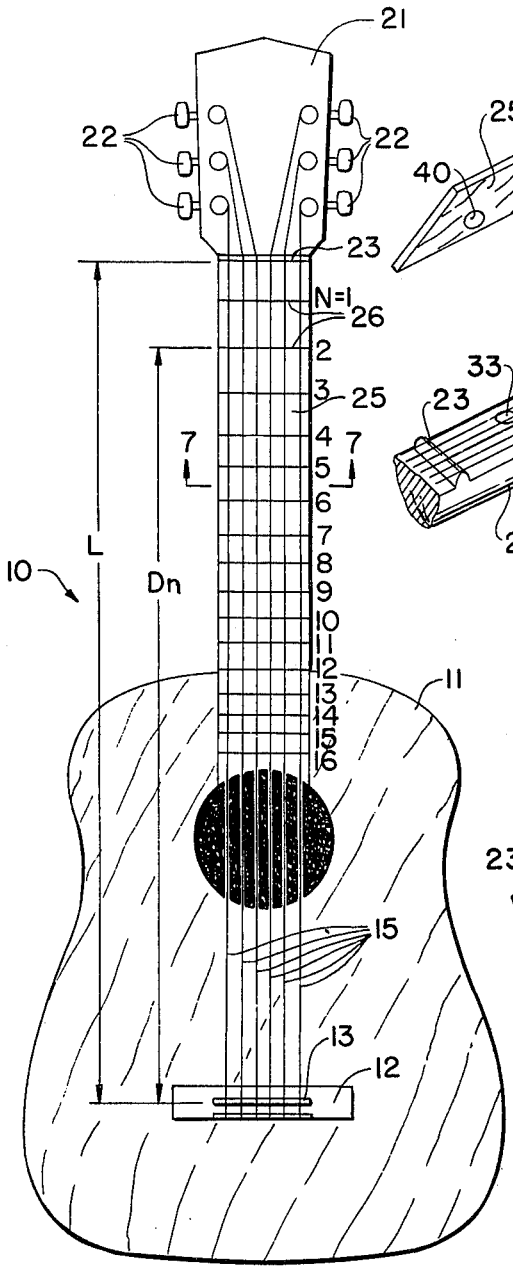
FIG. 1 is a front elevational view of a guitar embodying the invention.

Turning now to the drawings, FIG. 1 illustrates a guitar generally designated by reference numeral 10 and embodying the invention. As seen in this Fig., guitar 10 comprises a body 11 having a bridge 12 mounted on the top surface thereof and on which a saddle 13 is positioned generally transversely of the body 11 which provides a first vibration stop for a plurality of strings 15.

Secured to body 11 at a joint 17 (FIG. 2) is a neck 20 extending away from body 11 and terminating in a head portion 21 to which a plurality of conventional tuning machines 22 are secured and which enable manual tuning of the individual strings 15. A conventional nut 23 is attached to the junction of neck 20 and head 21 to provide proper lateral string spacing and to provide the proper elevation of strings 15 above the playing surface of a fingerboard 25 in concert with saddle 13.

Fingerboard 25 has a plurality of transversely arranged frets 26 fabricated from suitable fret wire each spaced a different predetermined distance $D_n$ from saddle 13 to provide a given tonal scale in the manner described with particularity below. Unlike prior art devices, fingerboard 25 is detachably secured to neck 20 so that it may be quickly removed and replaced with a different fingerboard having frets 26 arranged in accordance with a different tonal scale desired by the performer. When installed as shown in FIG. 1, fingerboard 25 must be accurately positioned with respect to saddle 13 and must be rigidly connected to neck 20 in order to prevent relative movement therebetween.

Figure 2:
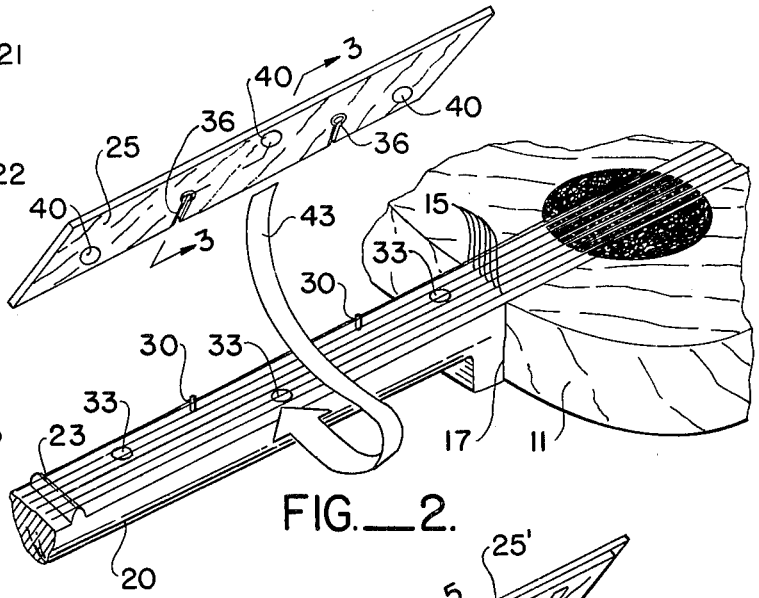
FIG. 2 is a schematic perspective view illustrating a first embodiment of the invention.
Figure 3:
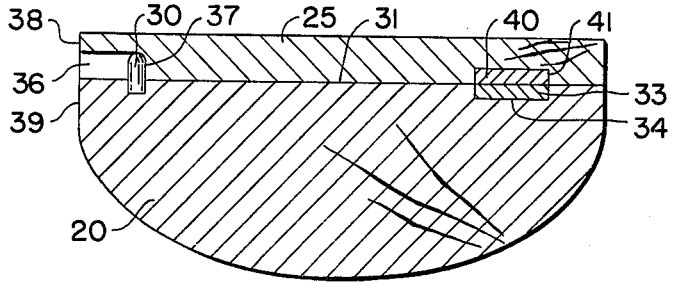
FIG. 3 is a sectional view taken after lines 3—3 of FIG. 2.

FIGS. 2 and 3 illustrate a first embodiment of the invention which affords rapid installation and removability of a given fingerboard 25 and a rigid connection therebetween. A plurality of pin-like projections 30 are embedded in the upper facing surface 31 of neck 20, with the projections 30 spaced along the length of neck 20 at predetermined locations and extending in the direction of strings 15. A plurality of magnetic or magnetizable disks 33 are also secured in recesses 34 of neck 20 at spaced locations therealong, with the upper surface of elements 33 flush with upper surface 31 of neck 20. A plurality of downwardly opening channels 36 are formed in fingerboard 25 transversely thereof at longitudinally spaced locations each corresponding to the location of a different one of pins 30. Each channel 36 terminates in a blind wall 37 having the same general contour as the contour of its associated pin 30 at a distance from the edge 38 of fingerboard 25 which is equal to the distance from the corresponding edge 39 of neck 20 to the remote wall surface of pin 30 so that the fingerboard 25 is in exact registry with the edges of neck 20 when installed. Fingerboard 25 is also provided with a plurality of magnetic or magnetizable disks 40 secured in downwardly opening recesses 41, with the lower surface of each disk 40 flush with the lower surface of fingerboard 25. Disk recesses 41 are formed in fingerboard 25 at locations which mate with recesses 34 in neck 20 so that corresponding disks 33, 40 are positioned in registry when the fingerboard is properly installed on the neck 20. Once installed, fingerboard 25 is rigidly secured to neck 20 by the magnetic force between disk elements 33 and 40.

To install, fingerboard 25 is inserted between strings 15 and neck 20 in the direction of arrow 43 (FIG. 2) with pins 30 in registry with corresponding channels 36 until the pins 30 are fully received in the channels 36. Removal proceeds in the opposite fashion.

Figure 4:
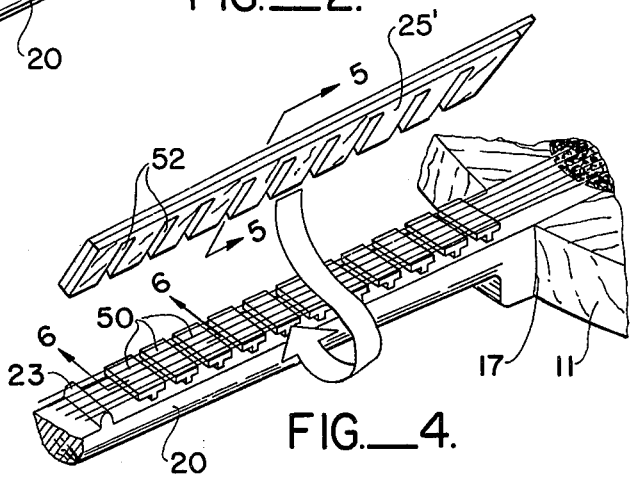
FIG. 4 is a schematic perspective exploded view illustrating an alternate embodiment of the invention.
Figure 5:
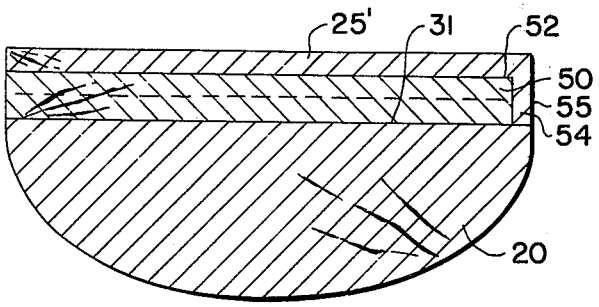
FIG. 5 is a sectional view taken along lines 5—5 of FIG. 4.
Figure 6:
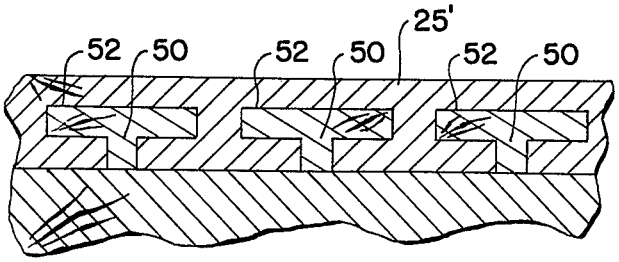
FIG. 6 is a section view taken after lines 6—6 of FIG. 4.

FIGS. 4–6 illustrate an alternate embodiment of the invention for enabling rapid installation and removal of a fingerboard 25′ and affording rigid attachment for the fingerboard 25′ once installed. In this embodiment, neck 20 is provided with a plurality of dove-tail elements 50 each having an upright T-shaped cross section as shown in FIG. 6, the elements 50 being spaced along the length of neck 20 at regular intervals. Fingerboard 25′ is provided with a plurality of corresponding channels 52 each having a T-shaped cross section as shown in FIG. 6 and being spaced along the length of fingerboard 25′ at identical distance to the spacing of elements 50 so that these latter elements dove-tail with the channels 52. At least some of the channels 52 terminate in a closed wall portion 54 adjacent edge 55 of fingerboard 25′ and the corresponding elements 50 are shortened accordingly to provide a limit stop during installation of fingerboard 25′ so that this latter element may be properly registered with respect to neck 20. Removal and installation of fingerboard 25′ is substantially identical to that already described for the embodiment of FIGS. 2 and 3.

Figure 7:
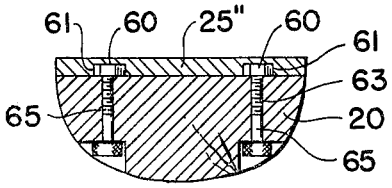
FIG. 7 is a sectional view taken along lines 7—7 of FIG. 1 illustrating an alternative embodiment of the invention.

FIG. 7 illustrates another alternate embodiment of the invention for affording rapid installation and removal of a fingerboard 25″ and rigid attachment. As seen in this Fig., fingerboard 25″ is provided with a plurality of internally threaded nuts 60 secured in recesses 61 in fingerboard 25″ and flush mounted with the lower surface thereof. Received in a plurality of correspondingly located through bores 63 formed in neck 20 are a corresponding plurality of externally threaded bolts 65 threadably engaged in nuts 60. In practice, a plurality of nuts 60 and bolts 65 are arranged along the length of neck 20 and fingerboard 25″ at regular intervals.

In each of the embodiments described above, the fingerboard may be installed and removed without disturbing strings 15. Once installed, the fingerboard is rigidly secured to the neck in a precisely determined location in order to function in a manner identical to that of a conventional permanently bonded fingerboard.

As noted above, frets 26 may be positioned on fingerboard 25 in accordance with any one of a number of tonal scales. For purposes of fret placement, there are two basic categories of tonal scales: viz. cyclic and linear. Cyclic scales are those which divide the octave, i.e. two tones bearing the frequency ratio of 2 to 1, into equal parts. An example of a cyclic scale is the 12 tone equal tempered scale commonly used in guitars and banjoes. Linear tonal scales are those having a set of tones which are not equal divisions of the octave. Examples of such tonal scales are the various mean-tone temperments (e.g. ⅓, ¼, 1/5 comma meantone), traditional just intonation, and the Pythagorean scale.

Figure 8:
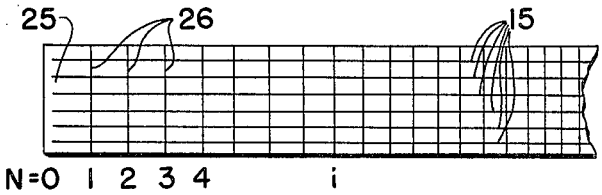
FIG. 8 is a top plan view of a removable fingerboard embodying a first type of musical scale.

For multiple stringed instruments, all cyclic scales may be provided on a fretted fingerboard by means of straight frets extending across the entire width of the fingerboard as illustrated in FIG. 8. This arrangement may also be used to provide some linear scales if all the strings 15 are tuned to unisons or octaves of the first degree of the tonal scale (since the resulting tones will only comprise those tones of the basic tonal scale under consideration). In addition, in some cases, when more than one string is tuned to a tone which is other than an octave or a unison of the first degree of the scale, a variation of the straight fret placement method described below may be used.

Figure 9:
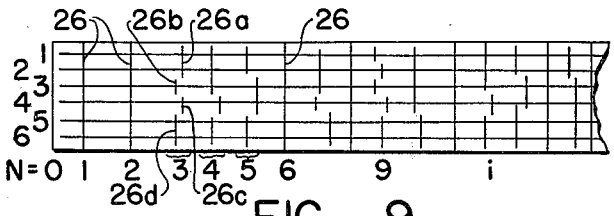
FIG. 9 is a top plan view of a removable fingerboard embodying a second type of musical scale.

FIG. 9 illustrates a fretted fingerboard provided with varied fret placement. As seen in this Fig., some of the degrees of the tonal scale, e.g. 1, 2 and 6, do employ straight frets 26. However, the remaining degrees of the scale require individual frets underlying less than all of the strings and which are slightly spaced longitudinally from the remaining individual frets of the same degree. For example, for the third degree of the tonal scale embodied in the fingerboard of FIG. 9, a first fret 26*a* underlies the first and second strings, a second fret 26*b* underlies the third string, a third fret 26*c* underlies the fourth string, and a fourth fret 26*d* underlies the fifth and sixth strings.

Figure 10:
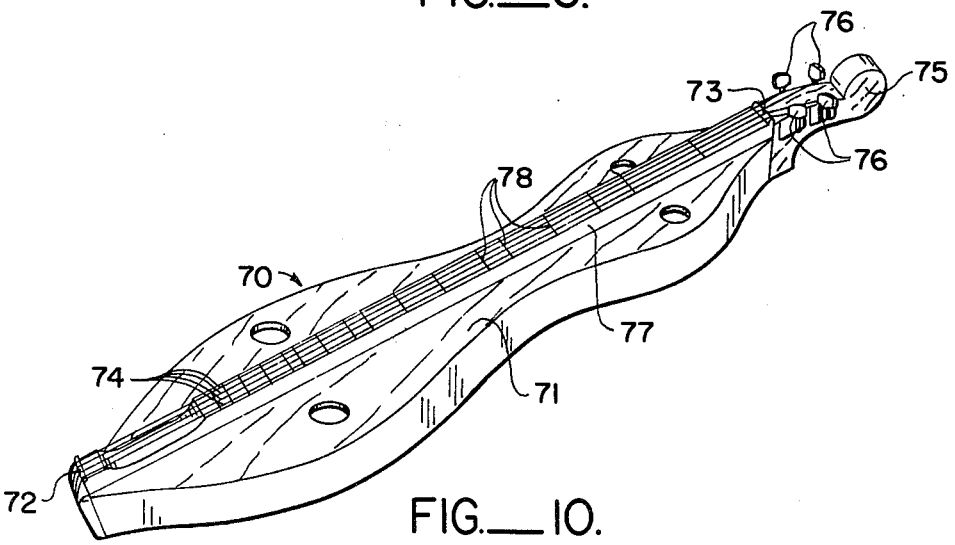
FIG. 10 is a perspective view of an alternate instrument suitable for employment of the invention.

Although the invention has been so far described with reference to a guitar, it should be noted that any stringed instrument employing a fretted fingerboard may embody the invention. For example, with reference to FIG. 10, a dulcimer generally indicated by reference numeral 70 is illustrated which has a main body portion 71 providing a sounding board, a bridge 72 and a nut 73 for providing fixed stops for a plurality of strings 74, a peg head 75 provided with a plurality of tuning machines 76, and a fretted fingerboard 77 bearing a plurality of frets 78. In accordance with the invention, fingerboard 77 is constructed in accordance with any of the above described alternate embodiments so as to be removably secured to body portion 71. As will be appreciated by those skilled in the art, the invention may also be implied to a banjo, or other stringed musical instruments employing frets, so that the musician may avail himself of a plurality of different tonal scales by simply interchanging fingerboards.

The placement of frets in the straight fret system is accomplished as follows:

(a) determine the frequency ratios of the scale in question; and (b) multiply the reciprocals of those frequency ratios by the string length to find the distance $D_n$ from the saddle 13 to the corresponding fret *n*.

$$(1/fn) \cdot L = D_n \qquad (1)$$

where $D_n$ is the distance from the saddle 13 to the *n*th fret, *n* is the fret number that serves to identify the *f* with the corresponding D,

*f* is the frequency ratio number for the tone that will be made by stopping a string 15 at the *n*th fret, and

*L* is the length of the string.

In those cases where a linear scale can be provided with straight fret placement the above straight fret placement formula is used. If a linear scale is to be used with straight fret placement and the nut 23 of the instrument will not correspond to the first scale degree then the procedure must be varied in the manner noted below.

The following is an example of straight fret placement for the 12 tone equal temperment tonal scale for a six string guitar of string length $L = 26.2$ inches.

| Scale degree | Fret # (n) | Frequency ratios ($f_n$) | Resulting fret placement ($D_n$) distance from saddle 13 |
|---|---|---|---|
| 1 | 0 (nut) | 1.00000 | 26.200 |
| 2 | 1 | 1.05946 | 24.729 |
| 3 | 2 | 1.12246 | 23.342 |

-continued

| Scale degree | Fret # (n) | Frequency ratios ($f_n$) | Resulting fret placement ($D_n$) distance from saddle 13 |
|---|---|---|---|
| 4 | 3 | 1.18920 | 22.031 |
| 5 | 4 | 1.25992 | 20.795 |
| 6 | 5 | 1.33483 | 19.628 |
| 7 | 6 | 1.41421 | 18.526 |
| 8 | 7 | 1.49803 | 17.486 |
| 9 | 8 | 1.58740 | 16.505 |
| 10 | 9 | 1.68179 | 15.579 |
| 11 | 10 | 1.78179 | 14.713 |
| 12 | 11 | 1.88774 | 13.879 |
| 1 | 12 | 2.00000* | 13.100** |
| 2 | 13 | | |
| 3 | 14 | | |
| 4 | 15 | | |
| etc. | etc. | | |

The frets are placed straight across the fingerboard at the distances indicated in column D.

To obtain the frequency ratios for higher octaves of the tones of any scale multiply the initial frequency ratio numbers *f* by a factor of 2 for each octave. Similarly, to obtain the value D*n* for the higher fret numbers beginning with n=13, divide the value of $D_n$ for the corresponding scale degree by a factor of 2 for each octave.

The placement of frets in the varied fret system is accomplished as follows:

(a) list the frequency ratio numbers *fn* for the scale under consideration for a full two octaves. List the scale degrees along side.

(b) Determine the desired tuning of the open strings and list the frequency ratio number of each string as tuned.

(c) Determine the scale degree to which each string is tuned, staying within the first octave of the scale.

(d) Determine the $f_n$ of each of the scale degrees.

(e) Starting with the $f_n$ of the scale degree for a given open string, make a column of all the $f_n$s from the scale degree of the same scale degree one octave higher, using the list set out in step (a).

(f) Repeat step (e) for each string.

(g) For each column, divide the numbers of that column by the number at the top of the column, including the top number itself, placing the results in the same order as the numbers in that column, respectively.

(h) Apply the formula $(1/f_n) \times L = D_n$ for each string individually.

The resulting numbers are the distances from the saddle to the frets, with one column of numbers for each string.

Where the numbers are the same for two or more adjacent strings, a single fret may be used to provide the scale degree to those strings. Otherwise, individual frets having a length just sufficient to provide a stop for a single string are required.

The following is an example of varied fret placement for the Just Intonation tonal scale in D with the individual strings tuned in ascending tonal order D A D G B E .

STEP (A)

| Scale degrees | Frequency ratio numbers $f_n$ |
|---|---|
| 1 | 1.00000 |
| 2 | 1.05468 |
| 3 | 1.12500 |
| 4 | 1.20000 |
| 5 | 1.25000 |
| 6 | 1.33333 |
| 7 | 1.40625 |
| 8 | 1.50000 |
| 9 | 1.60000 |

-continued

| Scale degrees | Frequency ratio numbers $f_n$ |
|---|---|
| 10 | 1.66666 |
| 11 | 1.80000 |
| 12 | 1.87500 |
| 1 | 2.00000 |
| 2 | 2.10936 |
| 3 | 2.25000 |
| 4 | 2.40000 |
| 5 | 2.50000 |
| 6 | 2.66666 |
| 7 | 2.81250 |
| 8 | 3.00000 |
| 9 | 3.20000 |
| 10 | 3.33333 |
| 11 | 3.60000 |
| 12 | 3.75000 |
| 1 | 4.00000 |

STEP (B)

The letter names of the strings starting from the lowest in pitch or sixth string are D A D G B E. The frequecy ratios of this tuning in just intonation are:

| String number | Letter names | Frequency ratio number ($f_n$) |
|---|---|---|
| 6 | D | 1.00000 |
| 5 | A | 1.50000 |
| 4 | D | 2.00000 |
| 3 | G | 2.66666 |
| 2 | B | 3.33333 |
| 1 | E | 4.50000 |

STEPS (C) AND (D)

The frequency ratio number for each string is derived from the frequency ratios of the scale in question by multiplying the appropriate $f_n$ by powers of 2 to arrive at the proper octave.

| String | Letter Name | Scale degree | Tuning | $f_n$ |
|---|---|---|---|---|
| 6 | D | 1 | 1.00000 | 1.00000 (x1) |
| 4 | D | | 2.00000 | (x2) |
| | | 2 | | 1.05468 |
| 1 | E | 3 | 4.50000 | 1.12500 (x4) |
| | | 4 | | 1.20000 |
| | | 5 | | 1.25000 |
| 3 | G | 6 | 2.66666 | 1.33333 (x2) |
| | | 7 | | 1.40625 |
| 5 | A | 8 | 1.50000 | 1.50000 (x1) |
| | | 9 | | 1.60000 |
| 2 | B | 10 | 3.33333 | 1.66666 (x2) |
| | | 11 | | 1.80000 |
| | | 12 | | 1.87500 |

STEP (E)

| Scale degrees | $f_n$ for string #6 | |
|---|---|---|
| 1 | 1.00000 | |
| 2 | 1.05468 | |
| 3 | 1.12500 | |
| 4 | 1.20000 | |
| 5 | 1.25000 | |
| 6 | 1.33333 | $f_n$ for string #5 |
| 7 | 1.40625 | |
| 8 | 1.50000 | 1.50000 |
| 9 | 1.60000 | 1.60000 |
| 10 | 1.66666 | 1.66666 |
| 11 | 1.80000 | 1.80000 |
| 12 | 1.87500 | 1.87500 |
| 1 | 2.00000 | 2.00000 |
| 2 | 2.10936 | 2.10936 |
| 3 | 2.25000 | 2.25000 |
| 4 | 2.40000 | 2.40000 |
| 5 | 2.50000 | 2.50000 |
| 6 | 2.66666 | 2.66666 |
| 7 | 2.81250 | 2.81250 |

-continued

| Scale degrees | $f_n$ for string #6 | |
|---|---|---|
| 8 | 3.00000 | 3.00000 |
| 9 | 3.20000 | |
| 10 | 3.33333 | |
| 11 | 3.60000 | |
| 12 | 3.75000 | |
| 1 | 4.00000 | |

STEP (F)

| String # | 6 | 5 | 4 | 3 | 2 | 1 |
|---|---|---|---|---|---|---|
| Letter Name | D | A | D | G | B | E |
| Tuning | 1.00000 | 1.50000 | 2.00000 | 2.66666 | 3.33333 | 4.50000 |
| $f_n$ of open string | 1.00000 | 1.50000 | 1.00000 | 1.33333 | 1.66666 | 1.12500 |
| $f_n$ | 1.00000 | 1.50000 | 1.00000 | 1.33333 | 1.66666 | 1.12500 |
| | 1.05468 | 1.60000 | 1.05468 | 1.40625 | 1.80000 | 1.20000 |
| | 1.12500 | 1.66666 | 1.12500 | 1.50000 | 1.87500 | 1.25000 |
| | 1.20000 | 1.80000 | 1.20000 | 1.60000 | 2.00000 | 1.33333 |
| | 1.25000 | 1.87500 | 1.25000 | 1.66666 | 2.10936 | 1.40625 |
| | 1.33333 | 2.00000 | 1.33333 | 1.80000 | 2.25000 | 1.50000 |
| | 1.40625 | 2.10936 | 1.40625 | 1.87500 | 2.40000 | 1.60000 |
| | 1.50000 | 2.25000 | 1.50000 | 2.00000 | 2.50000 | 1.66666 |
| | 1.60000 | 2.40000 | 1.60000 | 2.10936 | 2.66666 | 1.80000 |
| | 1.66666 | 2.50000 | 1.66666 | 2.25000 | 2.81250 | 1.87500 |
| | 1.80000 | 2.66666 | 1.80000 | 2.40000 | 3.00000 | 2.00000 |
| | 1.87500 | 2.81250 | 1.87500 | 2.50000 | 3.20000 | 2.10936 |
| | 2.00000 | 3.00000 | 2.00000 | 2.66666 | 3.33333 | 2.25000 |
| Step (g) | | | | | | |
| Strings | 6 | 5 | 4 | 3 | 2 | 1 |
| $f_n$ n=0 | 1.00000 | 1.00000 | 1.00000 | 1.00000 | 1.00000 | 1.00000 |
| 1 | 1.05468 | 1.06666 | 1.05468 | 1.05469* | 1.08000 | 1.06666 |
| 2 | 1.12500 | 1.11110 | 1.12500 | 1.12500 | 1.12500 | 1.11111 |
| 3 | 1.20000 | 1.20000 | 1.20000 | 1.20000 | 1.20000 | 1.18518 |
| | 1.25000 | 1.25000 | 1.25000 | 1.24999* | 1.26562 | 1.25000 |
| | 1.33333 | 1.33333 | 1.33333 | 1.35000 | 1.35000 | 1.33333 |
| | 1.40625 | 1.40624* | 1.40625 | 1.40625 | 1.44000 | 1.42222 |
| | 1.50000 | 1.50000 | 1.50000 | 1.50000 | 1.50000 | 1.48147 |
| | 1.60000 | 1.60000 | 1.60000 | 1.58202 | 1.60000 | 1.60000 |
| | 1.66666 | 1.66666 | 1.66666 | 1.68750 | 1.68750 | 1.66666 |
| | 1.80000 | 1.77777 | 1.80000 | 1.80000 | 1.80000 | 1.77777 |
| | 1.87500 | 1.87500 | 1.87500 | 1.87500 | 1.92000 | 1.87498* |
| | 2.00000 | 2.00000 | 2.00000 | 2.00000 | 2.00000 | 2.00000 |

*Differences in the last 1, 2, or 3 decimal places are negligible and in these cases are caused by accumulation of error due to not carrying the $f_n$ in step (a) to more decimal places.

STEP (H)

In this example a string length of 26.2 inches is used:

-continued

String #6

| | | |
|---|---|---|
| $\frac{1}{f_n} \cdot L = D_n$ | example: | $\frac{1}{f0} \cdot L = D_0$ |

Where; $f_n$ is the number from the column in step (g) above, n is the fret number that serves to identify the f with its corresponding D., L is the string length, and $D_n$ is the distance of the nth fret from the saddle 13.

| | |
|---|---|
| n= 0 | $\frac{1}{1.00000} \cdot 26.2 = 26.2$ |
| n=1 | $\frac{1}{1.05468} \cdot 26.2 = 24.84165$ |
| n=2 | $\frac{1}{1.12500} \cdot 26.2 = 23.28888$ |
| n=3 | $\frac{1}{1.20000} \cdot 26.2 = 21.83333$ |

Etc.

The complete table is as follows:

| Fret# | Strings 6 | 5 | 4 | 3 | 2 | 1 |
|---|---|---|---|---|---|---|
| 0 (nut) | 26.20000 | 26.20000 | 26.20000 | 26.20000 | 26.20000 | 26.20000 |
| 1 | 24.84165 | 24.56265 | 24.84165 | 24.84142 | 24.25925 | 24.56265 |
| 2 | 23.28888 | 23.58023 | 23.28888 | 23.28888 | 23.28888 | 23.58002 |
| 3 | 21.83333 | 21.83333 | 21.83333 | 21.83333 | 21.83333 | 22.10634 |
| 4 | 20.96000 | 20.96000 | 20.96000 | 20.96016 | 20.70131 | 20.96000 |
| 5 | 19.65004 | 19.65004 | 19.65004 | 19.40740 | 19.40740 | 19.65004 |
| 6 | 18.63111 | 18.63124 | 18.63111 | 18.63111 | 18.19444 | 18.42190 |
| 7 | 17.46666 | 17.46666 | 17.46666 | 17.46666 | 17.46666 | 17.68513 |
| 8 | 16.37500 | 16.37500 | 16.37500 | 16.56110 | 16.37500 | 16.37500 |
| 9 | 15.72006 | 15.72006 | 15.72006 | 15.52592 | 15.52592 | 15.72006 |
| 10 | 14.55555 | 14.73756 | 14.55555 | 14.55555 | 14.55555 | 14.73756 |
| 11 | 13.97333 | 13.97333 | 13.97333 | 13.97333 | 13.64583 | 13.97348 |
| 12 | 13.10000 | 13.10000 | 13.10000 | 13.10000 | 13.10000 | 13.10000 |

The measurements in the above table are in inches. In the manufacture of fingerboards, using this procedure for determining the fret placement, the resulting numbers can be rounded off to the third decimal place to eliminate slight differences which are due to the accumulation of error as explained at the end of step (g). If adjacent numbers in a given row differ by merely 0.001 in., they may be made equal since an error of 0.001 will not be noticeable in the completed fingerboard.

As noted above, in some cases (viz. if more than one string is tuned to a tone which is other than an octave or a unison of the first degree of the scale) linear scales may be provided with straight fret placement by using a variant of the straight fret placement method. When a linear scale is to be provided with straight fret placement and the nut of the instrument does not correspond to the first scale degree, the starting degree of the scale for a given string is merely shifted to a different degree than zero. In such a case, the formula for $D_n$ from step (h) above is merely applied to a table of $f_n$s similar to those listed in the extreme right hand column of step (e).

In addition to the 12 tone equal temperment scale noted above, there are other cyclic scales which may be employed with the straight fret placement technique. For example, tonal scales based on 19, 24, 31, 50, or other numbers of equal divisions of the octave may be employed.

Similarly, for varied fret placement many different linear scales than the Just Intonation Scale in D noted above may be employed. The following is a partial list.

- ¼ comma meantone temperment
- Traditional "Just intonation"
- Pythagorean scale
- Just intonation based on the prime factors 2, 3, 5 and 19, and variations thereof
- The 16th thru 32 harmonics from Tom Stone's Evolutionary Music System (EMS 16–32)
- EMS 2, 3, 19
- 18/17 system
- Indian system of 22 shruti
- 17 note classical Arabian scale There are many other scales from different cultures, periods of history of those cultures (particularly western culture) and new experimental scales which have been omitted to avoid prolixity. Each of these scales has its own characteristics, qualities, limitations and possibilities, which accounts for the great variety of scales and systems of intonation in the world. To use such scales it is only necessary to determine the frequency ratios and follow the steps outlined above for varied fret placement.

Tables

In the following tables, the frequency ratios (f) are given for one full octave. For higher octaves multiply the frequency ratios by a factor of 2 for each octave.

| 1. 12 tone Equal Temperment | | 2. 1/4 comma meantone | |
|---|---|---|---|
| Scale degrees | Frequency ratios | Scale degrees | Frequency ratios |
| 1 | 1.00000 | 1 | 1.00000 |
| 2 | 1.05946 | 2 | 1.04490 |
| 3 | 1.12246 | 3 | 1.11803 |
| 4 | 1.89207 | 4 | 1.19627 |
| 5 | 1.25992 | 5 | 1.25000 |
| 6 | 1.33483 | 6 | 1.33748 |
| 7 | 1.41421 | 7 | 1.39754 |
| 8 | 1.49830 | 8 | 1.49534 |
| 9 | 1.58740 | 9 | 1.60000 |
| 10 | 1.68179 | 10 | 1.67185 |
| 11 | 1.78179 | 11 | 1.78885 |
| 12 | 1.88774 | 12 | 1.86918 |
| 1 | 2.00000 | 1 | 2.00000 |

| 3. Traditional "just" | | 4. Pythagorean scale | |
|---|---|---|---|
| Scale degree | Frequency ratios | Scale degree | Frequency ratios |
| 1 | 1.00000 | 1 | 1.00000 |
| 2 | 1.05468 | 2 | 1.06787 |
| 3 | 1.12500 | 3 | 1.12500 |
| 4 | 1.20000 | 4 | 1.20135 |
| 5 | 1.25000 | 5 | 1.26562 |
| 6 | 1.33333 | 6 | 1.33333 |
| 7 | 1.40625 | 7 | 1.42382 |
| 8 | 1.50000 | 8 | 1.50000 |
| 9 | 1.60000 | 9 | 1.60180 |
| 10 | 1.66666 | 10 | 1.68750 |
| 11 | 1.80000 | 11 | 1.80203 |
| 12 | 1.87500 | 12 | 1.89843 |
| 1 | 2.00000 | 1 | 2.00000 |

Tables-continued

| 5. Just intonation (2,3,5,19) | | 6. a variation of 5. | |
|---|---|---|---|
| Scale degrees | Frequency ratios | Scale degrees | Frequency ratios |
| 1 | 1.00000 | 1 | 1.00000 |
| 2 | 1.04166 | 2 | 1.05468 |
| 3 | 1.12500 | 3 | 1.12500 |
| 4 | 1.18750 | 4 | 1.18750 |
| 5 | 1.12500 | 5 | 1.25000 |
| 6 | 1.33333 | 6 | 1.33593 |
| 7 | 1.41015 | 7 | 1.40625 |
| 8 | 1.50000 | 8 | 1.50000 |
| 9 | 1.58333 | 9 | 1.56250 |
| 10 | 1.66666 | 10 | 1.68750 |
| 11 | 1.78125 | 11 | 1.78125 |
| 12 | 1.87500 | 12 | 1.87500 |
| 1 | 2.00000 | 1 | 2.00000 |

| 7. Just with commas | | 8. EMS 16–32 | |
|---|---|---|---|
| Scale degree | Frequency ratios | Scale degree | Frequency ratios |
| 1 | 1.00000 | 1 | 1.00000 |
| 2 | 1.04166 | 2 | 1.06250 |
| 3 | 1.05468 | 3 | 1.12500 |
| 4 | 1.12500 | 4 | 1.18750 |
| 5 | 1.18750 | 5 | 1.25000 |
| 6 | 1.25000 | 6 | 1.31250 |
| 7 | 1.26562 | 7 | 1.37500 |
| 8 | 1.33333 | 8 | 1.43750 |
| 9 | 1.33593 | 9 | 1.50000 |
| 10 | 1.40625 | 10 | 1.52650 |
| 11 | 1.50000 | 11 | 1.62500 |
| 12 | 1.58333 | 12 | 1.68750 |
| 13 | 1.66666 | 13 | 1.75000 |
| 14 | 1.68750 | 14 | 1.81250 |
| 15 | 1.78125 | 15 | 1.87500 |
| 16 | 1.87500 | 16 | 1.93750 |
| 1 | 2.00000 | 1 | 2.00000 |

| 9. EMS (2,3,19) | | 10. 18/17 system for guitars | |
|---|---|---|---|
| Scale degree | Frequency ratios | Scale degree | Frequency ratios |
| 1 | 1.00000 | 1 | 1.00000 |
| 2 | 1.05555 | 2 | 1.05882 |
| 3 | 1.12500 | 3 | 1.12110 |
| 4 | 1.18750 | 4 | 1.18705 |
| 5 | 1.26562 | 5 | 1.25688 |
| 6 | 1.33593 | 6 | 1.33081 |
| 7 | 1.42382 | 7 | 1.40909 |
| 8 | 1.50000 | 8 | 1.49198 |
| 9 | 1.58333 | 9 | 1.57975 |
| 10 | 1.68750 | 10 | 1.67267 |
| 11 | 1.78125 | 11 | 1.77106 |
| 12 | 1.89843 | 12 | 1.87525 |
| 1 | 2.00000 | 1 | 2.00000 |

| 11. 22 shruti | | 12. Classical Arabic system | |
|---|---|---|---|
| Scale degree | Frequency ratios | Scale degree | Frequency ratios |
| 1 | 1.00000+2.00000 | 1 | 1.00000 |
| 2 | 1.05349 | 2 | 1.05468 |
| 3 | 1.06666 | 3 | 1.11111 |
| 4 | 1.11111 | 4 | 1.12500 |
| 5 | 1.12500 | 5 | 1.18518 |
| 6 | 1.18518 | 6 | 1.25000 |
| 7 | 1.20000 | 7 | 1.26562 |
| 8 | 1.25000 | 8 | 1.33333 |
| 9 | 1.26562 | 9 | 1.40625 |
| 10 | 1.33333 | 10 | 1.48148 |
| 11 | 1.35000 | 11 | 1.50000 |
| 12 | 1.40625 | 12 | 1.58024 |
| 13 | 1.42382 | 13 | 1.66666 |
| 14 | 1.50000 | 14 | 1.68750 |
| 15 | 1.58024 | 15 | 1.77777 |
| 16 | 1.60000 | 16 | 1.87500 |
| 17 | 1.66666 | 17 | 1.97530 |
| 18 | 1.68750 | 1 | 2.00000 |
| 19 | 1.77777 | | |
| 20 | 1.80000 | | |
| 21 | 1.87500 | | |
| 22 | 1.89843 | | |

As will now be apparent, fretted instruments fabricated in accordance with the teachings of the invention permit a performer an unparalled degree of flexibility in selecting various tonal scales for a single stringed instrument. For example, to perform musical compositions from many different tonal scales, it is only necessary to select a corresponding number of detachable fingerboards each having fret placement in accordance with a different one of the desired tonal scales, and to use each different fingerboard with the single basic instrument. Further, due to rapid manner with which a given fingerboard may be removed and a different fingerboard installed, the invention lends itself quite readily to concert use. Lastly, the varied fret placement technique can be employed to produce a fretted fingerboard embodying any desired tonal scale.

While the above provides a full and complete disclosure of the preferred embodiments of the invention, various modifications, alternate constructions and equivalents may be employed without departing from the true spirit and scope of the invention. Therefore the above description and illustrations should not be construed as limiting the scope of the invention which is defined by the appended claims.

What is claimed is:

1. A fretted stringed musical instrument adapted to provide a plurality of predetermined tonal scales, each contained on a different quickly attachable and detachable fingerboard, said instrument comprising:

a body;

fingerboard mounting means secured to said body for enabling rapid attachment and detachment of a fingerboard;

at least one string arranged along said fingerboard mounting means;

first means at a first location for securing a first end of said at least one string;

means adjacent said first string securing means for providing a first vibration stop for said at least one string;

second means at a second location for securing the remaining end of said at least one string;

means adjacent said second string securing means for providing a second vibration stop for said at least one string; and a fingerboard detachably secured to said fingerboard mounting means at a predetermined location relative to said first and second vibration stops and having a plurality of frets lying below said at least one string, said frets being arranged along the length of said fingerboard in accordance with said predetermined tonal scale, each said fret providing an additional vibration stop for said at least one string when the latter is placed in contact therewith, said fingerboard being devoid of string engaging means when said at least one string is in an at-rest position in order to permit said fingerboard to be rapidly exchanged for another fingerboard having a different tonal scale without requiring substantial slackening of said at least one string.

2. The combination of claim 1 wherein said fingerboard mounting means has an upper surface and said fingerboard has a lower surface facing said upper surface;

said fingerboard mounting means having a plurality of projecting members spaced therealong at first predetermined locations and extending from said upper surface, and a plurality of magnetizable members spaced therealong at second predetermined locations and secured therein, each said magnetizable member having a surface substantially co-planar with said upper surface;

said fingerboard having a plurality of laterally extending channels spaced therealong at locations corresponding to said first locations of said projecting members, and a plurality of magnetizable members spaced therealong at locations corresponding to said second locations of said magnetizable members of said fingerboard mounting means, each said magnetizable member of said fingerboard having a surface substantially co-planar with said lower surface;

each said projecting member being received in a different one of said channels and each said magnetizable member of said fingerboard mounting means being in registry with a different one of said magnetizable members of said fingerboard.

3. The combination of claim 1 wherein said fingerboard mounting means has an upper surface and said fingerboard has a lower surface facing said upper surface;

said fingerboard mounting means and said fingerboard including mating dove-tail members secured to said upper and said lower surfaces, respectively and arranged in mating engagement.

4. The combination of claim 1 wherein said fingerboard mounting means comprises a neck secured to said body at a junction and said first string securing means is coupled to said neck at a first location remote from said junction.

5. The combination of claim 1 wherein said instrument has a plurality of laterally spaced strings, and wherein said tonal scale comprises an ordered plurality of degrees, at least one of said degrees requiring a plurality of individual frets associated to that degree, said associated frets each having a length less than that required to span said strings;

the combined length of said associated frets being sufficient to span said strings, at least two of said associated frets being spaced along said fingerboard.

6. A fretted stringed musical instrument for use with at least one string and a plurality of quickly detachable fingerboards each having frets arranged along the length thereof in accordance with a different predetermined tonal scale and each being devoid of string engaging means when said at least one string is in an at-rest position, said instrument comprising:

a body;

first means for enabling one end of said string to be secured to said instrument;

means adjacent said first string securing means for providing a first vibration stop for said at least one string;

second means for enabling the remaining end of said string to be secured to said instrument;

means adjacent said second string securing means for providing a second vibration stop for said at least one string; and fingerboard mounting means for enabling said fingerboards to be rapidly attached to and rapidly detached from said body with the frets thereof in proper alignment relative to said first and second to permit said fingerboard to be rapidly exchanged for another fingerboard having a different tonal scale without requiring substantial slackening of said at least one string.

7. The combination of claim 6 wherein said fingerboard mounting means includes a neck secured to said body at a junction and said first enabling means is positioned remote from said junction.

8. The combination of claim 6 wherein said fingerboard mounting means includes an upper surface, a plurality of projecting members spaced along said body at first predetermined locations and extending from said upper surface, and a plurality of magnetizable members spaced therealong at second predetermined locations and secured therein, each said magnetizable member having a surface substantially co-planar with said upper surface.

9. The combination of claim 6 wherein said fingerboard mounting means includes an upper surface and a plurality of longitudinally spaced dove-tail members extending upwardly from said upper surface for engagement with complementary dove-tail members secured to said fingerboard.

10. For use with a fretted stringed musical instrument having a body, a fingerboard mounting means secured to said body, at least one string arranged along said fingerboard mounting means, first means for securing a first end of said at least one string, means adjacent said first means for providing a first vibration stop for said at least one string, second means for securing the remaining end of said at least one string, and means for providing a second vibration stop adjacent said second means for said at least one string; a plurality of quickly removable fretted fingerboards, each having a plurality of frets arranged along the length thereof in accordance with a predetermined tonal scale and means for enabling each said fingerboard to be rapidly attached to and rapidly detached from said fingerboard mounting means, each said fingerboard being devoid of string engaging means when said at least one string is in an at-rest position in order to permit said fingerboard to be rapidly exchanged for another fingerboard having a different tonal scale without requiring substantial slackening of said at least one string.

11. The combination of claim 10 wherein said fingerboard has a lower surface and said enabling means comprises a plurality of dove-tail members secured to said lower surface of said fingerboard and adapted to be engaged with a complementary plurality of mating dove-tail members secured to the upper surface of said fingerboard mounting means.

12. The combination of claim 10 wherein said instrument has a plurality of strings, and wherein said tonal scale comprises an ordered plurality of degrees, at least one of said degrees requiring a plurality of individual frets associated to that degree, said associated frets each having a length less than that required to span said strings, the combined length of said associated frets being sufficient to span said strings, at least two of said associated frets being spaced along said fingerboard.

13. The combination of claim 19 wherein said fingerboard has a lower surface and said enabling means includes a plurality of laterally extending channels spaced along said fingerboard at first locations, each channel adapted to receive a different one of a plurality of projecting members secured to said fingerboard mounting means; and a plurality of magnetizable members spaced along said fingerboard at second locations, each said magnetizable member having a surface substantially co-planar with said lower surface of said fingerboard, each said magnetizable member being adapted to register with a different one of a plurality of magnetizable members secured to said fingerboard mounting means.

* * * * *